US005231405A

United States Patent [19]

Riza

[11] Patent Number: 5,231,405

[45] Date of Patent: Jul. 27, 1993

[54] TIME-MULTIPLEXED PHASED-ARRAY ANTENNA BEAM SWITCHING SYSTEM

[75] Inventor: Nabeel A. Riza, Clifton Park, N.Y.

[73] Assignee: General Electric Company, Schenectady, N.Y.

[21] Appl. No.: 826,501

[22] Filed: Jan. 27, 1992

[51] Int. Cl.[5] ..... H01Q 3/34

[52] U.S. Cl. ..... 342/375; 342/158

[58] Field of Search ..... 342/54, 157, 158, 81, 342/96, 374, 375; 359/135, 138, 152

[56] References Cited

U.S. PATENT DOCUMENTS

| | | | |
|---|---|---|---|
| 4,929,956 | 5/1990 | Lee et al. | 342/376 |
| 5,117,239 | 5/1992 | Riza | 342/375 |
| 5,144,321 | 9/1992 | Biet | 342/375 |

OTHER PUBLICATIONS

"Acousto-Optic Control of Phased-Array Antennas" by Nabeel A. Riza, GE Technical Information Series, pp. 1-33, May, 1990.

*Primary Examiner*—Thomas H. Tarcza
*Assistant Examiner*—Patrick J. Finnan
*Attorney, Agent, or Firm*—Donald S. Ingraham; Marvin Snyder

[57] ABSTRACT

An optical control system for a phased-array antenna system employs a time-multiplexed optical control architecture to provide very fast (a few hundred beams per second) antenna beam scanning using slow (milliseconds) response spatial light modulators in two optical signal processing channels. In each channel a cascade of relatively slow switching speed nematic liquid crystal cell spatial light modulators and associated free space delay units or fiber optic delay cables are disposed to receive transmit or receive optical input signals comprising a plurality of light beams. The control voltages applied to the spatial light modulators determine the paths of the light beams through the cascade and the differential time delay imparted to the light beams in the input optical signal. High speed 90° polarization rotators control the polarization of the transmit and receive optical input signals and the polarization of optical signals passing from the cascade, allowing for selecting the active channel and the transmit or receive mode of the active channel, thus enabling sequential rapid beam scans of the radar with a relatively short dead time between respective transmit/receive sequences. The spatial light modulators in the non-active channel are reconfigured during the dwell time of the active channel to set up for the next transmit/receive sequence.

28 Claims, 6 Drawing Sheets

TIME-MULTIPLEXED PHASED-ARRAY ANTENNA BEAM SWITCHING SYSTEM

BACKGROUND OF THE INVENTION

This invention relates generally to optical signal processing systems and more particularly to beamforming controls for phased array antennas in radar systems.

Phased array antenna systems employ a plurality of individual antenna elements or subarrays of antenna elements that are separately excited to cumulatively produce a transmitted electromagnetic wave that is highly directional. The radiated energy from each of the individual antenna elements or subarrays is of a different phase, respectively, so that an equiphase beam front, or the cumulative wave front of electromagnetic energy radiating from all of the antenna elements in the array, travels in a selected direction. The difference in phase or timing between the antenna activating signals determines the direction in which the cumulative bean from all of the individual antenna elements is transmitted. Analysis of the phases of return beams of electromagnetic energy detected by the individual antennas in the array similarly allows determination of the direction from which a return beam arrives.

Beamforming, or the adjustment of the relative phase of the actuating signals for the individual antenna elements (or subarrays of antennas) can be accomplished by electronically shifting the phases of the actuating signals or by introducing a time delay in the different actuating signals to sequentially excite the antenna elements to generate the desired direction of beam transmission from the antenna. Electronically shifting the phases of a large number of actuating signals, such as is required in large sophisticated phased-array radars, requires extensive equipment, including switching devices to route the electrical signals through appropriate hardwired circuits to achieve the desired phase changes, and has numerous operational limitations which are drawbacks in a phased array system using broad band radiation.

Optical control systems, however, can be advantageously used to create selected time delays in actuating signals for phased array systems. Such optically generated time delays are not frequency dependent and thus can be readily applied to broadband phased array antenna systems. For example, optical signals can be processed to establish the selected time delays between individual signals to cause the desired sequential actuation of the transmitting antenna elements, and the optical signals can then be converted to electrical signals, such as by a photosensor array. Different optical architectures have been proposed to process optical signals to generate selected delays, such as routing the optical signal through optical fiber segments of different lengths or utilizing free space propagation based delay lines, which architecture typically incorporates polarizing beam splitters and prisms. Performance of both types of optical delay systems is a function, among other things, of the rapidity with which optical switching is accomplished. In fiber based systems, several optical switches have been suggested, for example lithium niobate electro-optic waveguide based cross-bar switches, electrically switched multiple semiconductor laser-based switches, and MESFET-based gallium arsenide $1\times2$ switches connected in a back-to-back configuration to implement a $2\times2$ electrical switch that implements optical switching using several semiconductor lasers. All of these switch systems are impractical for use in a large phased array antenna, e.g., an antenna having 1000 or more antenna elements, due to the high insertion loss, high crosstalk level, and high cost of the switches.

An optical beam forming system for a phased array antenna that avoids the above drawbacks is disclosed in the copending application of N. Riza entitled "Reversible Time Delay Beamforming Optical Architecture for Phased Array Antennas," Ser. No. 07/690,421, filed Apr. 24, 1991, allowed Dec. 18, 1991, and which is assigned to the assignee of the present invention and incorporated herein by reference. The optical control system disclosed in the above referenced application is a transmit/receive phased array beamformer for generating true-time-delays using optical free-space delay lines and two dimensional liquid crystal spatial light modulators for implementing the optical switching. Unlike the switching techniques mentioned earlier, the liquid crystal-based optical switching elements can provide low insertion loss and low crosstalk level switching with relatively easily fabricated and low cost liquid crystals. Liquid crystal-based optical switches, however, have relatively slow switch response times that limit the scanning speed of a phased array antenna.

High performance phased array radars preferably are able to scan several hundred beams per second while having a relatively long detection range. To achieve such performance it is important that the radar have a sufficiently long dwell time, i.e., the period when the array is transmitting or receiving along a given beam path, to provide the desired range capability, and have a minimum of dead time, i.e., the finite time it takes to reset the beamforming controls for a new beam direction during which the radar is not transmitting or receiving. Longer dead times necessitate that either the number of beams that can be scanned per second be limited or that the dwell time of each be limited; both of these limitations adversely affect radar performance, limiting range, the probability of detecting a target, and the rate at which target information is updated. Dead time thus preferably constitutes a very small percentage of the radar's dwell time. For example, in advanced conventional phased array radars using digital phase shifters controlling over 4000 antenna elements in an array, the percentage of dead time versus dwell time is about 0.2%, which corresponds to 200 scans or transmit/receive sequences per second having a dwell time per beam of about 5 msec, which corresponds to a maximum unambiguous range of 750 km, and a 10 μsec dead time between successive transmit/receive sequences.

The switching time for arrays using liquid crystal optical switches can range from tens of milliseconds to a few microseconds. Nematic liquid crystals switch in a few milliseconds using control voltages of about 3–5 volts, but have been shown to have switching times of about 100 μsec when control voltages of about 50 volts are used. Ferroelectric liquid crystals have demonstrated switching times of 10–100 μsec under control voltages of about 30–50 volts. Nematic liquid crystals are, however, more readily fabricated in large arrays at lower costs, and various thin-film transistor based addressing techniques have been developed for driving the liquid crystal pixels using approximately 5 volt control signals. In addition, nematic liquid crystals have shown up to 4000:1 on/off ratios. Thus, low voltage nematic liquid crystals are desirably used for large area two-dimensional liquid crystal switching arrays, with the key limitation being the several milliseconds switching time.

It is accordingly an object of this invention to provide a fast (a few hundred beams per second) opto-electronic signal control system for a phased array antenna that uses the relatively slow (several milliseconds response time) liquid crystal switching arrays in an optical true-time-delay beamforming architecture.

It is another object of the present invention to provide a fast (a few hundred beams per second) opto-electronic signal control system for a phased array antenna that provides a relatively short radar dead time to increase antenna sensitivity and probability of target detection.

It is another object of the present invention to provide a readily fabricated opto-electronic signal control system for a phased array antenna having a plurality of channels and that has low optical losses, low inter-channel crosstalk, and a relatively short dead time in switching between channels.

SUMMARY OF THE INVENTION

A time-multiplexed opto-electronic signal control system has two channels in which optical signals are processed by a plurality of relatively slow speed optical processing devices coupled together to differentially time delay the optical signals by a selected amount. The optical input and output signals of each channel are time multiplexed to allow rapid switching between the channels so that there is a relatively short dead time between the sequential output of each respective channel's processed signal.

The time multiplexed optical control signals generated by the system are advantageously used for beamforming for a phased array antenna and provide a fast (hundreds of beams/sec) beam switching rate (i.e., from one channel to the next) using relatively slow (milliseconds response) nematic liquid crystal (NLC) optical switching arrays in the optical architecture of each channel. Each channel processes both the signals to control the antenna beam in the transmit mode and the signals generated by returned beams detected by the antenna array in the receive mode. This time multiplexed sequential control arrangement enables one beam to be scanned as determined by the selected switch settings of the first channel NLC arrays while the second channel NLC arrays are switching to select the differential time delays to determine the beam form for the next subsequent beam; when the next beam is scanned, the first channel NLC arrays switch to set up for the next beam scan and so forth. The signal control system has a plurality of single pixel 90° fast switching polarization rotators to rapidly switch between the channels. The polarization rotators are disposed to select an active channel, and to select a transmit or receive mode for that active channel. The selection of the channel and the mode is effected by controlling the polarization orientation of the light beams entering the optical architecture of the control system.

A method of processing optical signals to control a phased array antenna in accordance with this invention includes the steps of causing the antenna to emit and receive electromagnetic radiation along a selected beam path in a predetermined transmit/receive sequence, and time multiplexing the control system for the antenna array to rapidly shift from one transmit/receive sequence to the next with a relatively short dead time between the respective transmit/receive sequences. During the dwell time of the active or driving channel's transmit/receive sequence, the optical control devices in the non-active channel are reconfigured for the next transmit/receive sequence. This method is applicable to both time-delayed optical control systems and phase-based optical control systems. In a time-delayed optical control system, the emitting and receiving steps each include steps of processing optical control signals in a signal processing channel selected to be active and to differentially time delay selected ones of the signals to determine the beam form in a transmit/receive sequence. Upon completion of a given transmit/receive sequence, a second signal processing channel is selected to be active by the time multiplexing means to control the beam form for the next transmit/receive sequence. The control settings for differentially time delaying signals in the non-active channel are adjusted so that the channel is set for controlling the formation of the beam in the next transmit/receive sequence.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE PREFERRED EMBODIMENT

Figure 1:
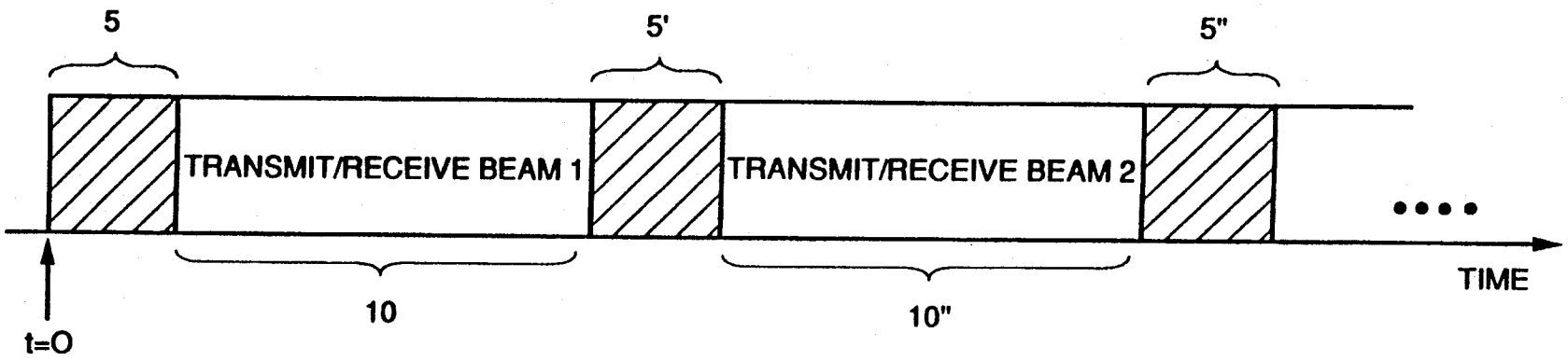
FIG. 1 (PRIOR ART)
FIG. 1 depicts a time line illustrating antenna beam scanning time and dead time for a conventional phased-array antenna system.

In a conventional phased-array radar, each of the microwave phase shifters in the beamforming control system must be configured before each transmit/receive sequence. The time to accomplish this configuration of the phase shifters before each transmit/receive sequence constitutes dead time when the radar is neither transmitting nor receiving. For example, as illustrated in the time line depicted in FIG. 1, an initial dead time 5 results from the time necessary to configure the phase shifters for forming the first beam to be transmitted. The transmit/receive sequence for the first beam transmitted has a dwell time 10; after the completion of that sequence, the phase shifters are reconfigured for transmitting the second beam, resulting in a dead time 5'. The second beam transmit/receive sequence has a dwell time 10', followed by a dead time 5'' for again reconfiguring the phase shifters, such dead time/dwell time sequences continuing during the operation of the radar. In a conventional high speed beam scanning phased-array radar, the dead times 5, 5', 5'', etc., each have a duration in the range of 1–10 microseconds, with dwell times having durations of about 5 milliseconds.

Figure 2:
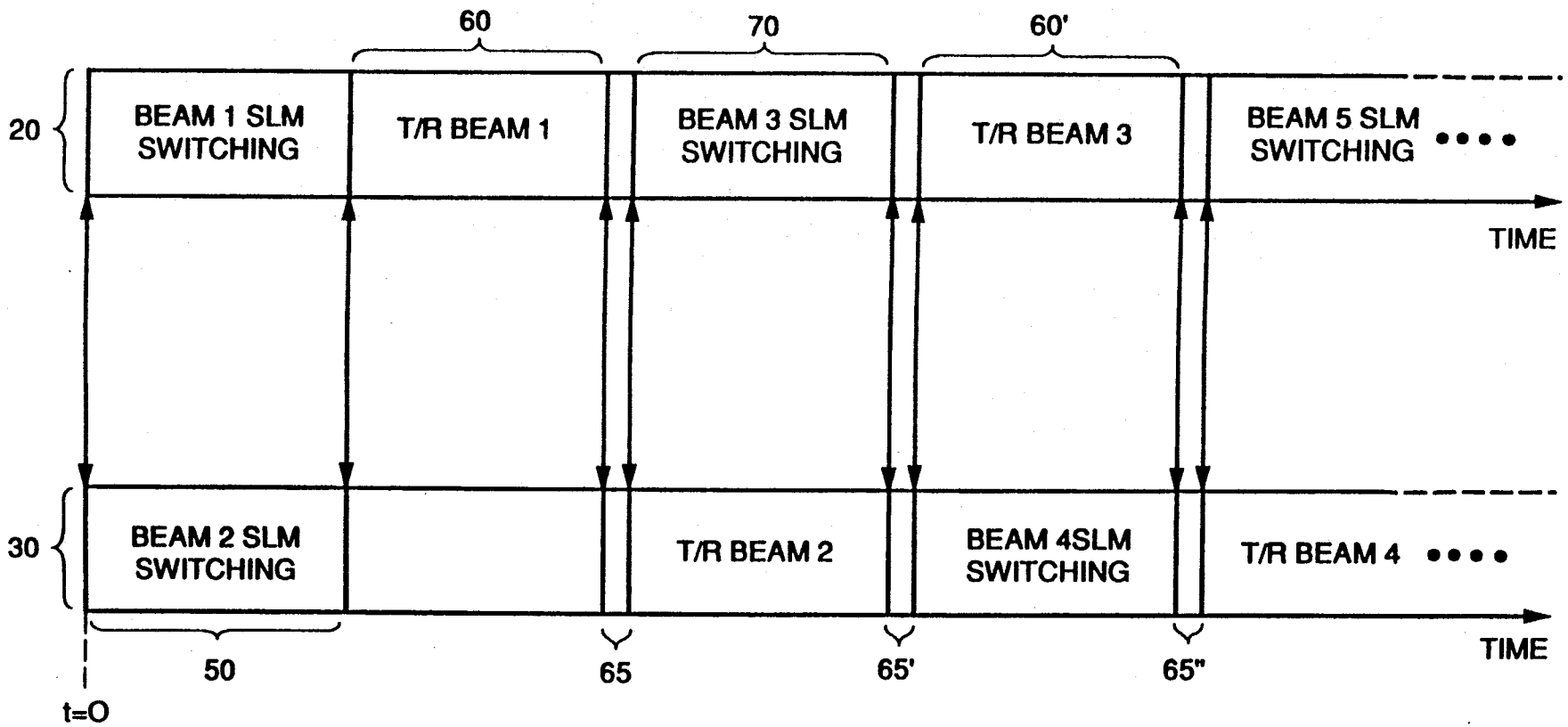
FIG. 2 depicts a time line illustrating antenna beam scanning time and dead time for a time-multiplexed optically controlled phased-array antenna system comprising the present invention.

In accordance with this invention, the dead time between successive transmit/receive sequences is significantly reduced, for example by three orders of magnitude. FIG. 2 depicts a time line illustrating transmit/-receive sequences, switching times, and dead times in a two channel, time-multiplexed opto-electronic phased array antenna system using slow response spatial light modulators (SLMs) in phased array beamforming. At radar start up, there is an initial dead time 50 on a first channel 20 as the opto-electronic switches are configured for forming the first beam to be transmitted. Simultaneously, the opto-electronic switches are configured in a second channel 30 to form the second beam to be transmitted. When the first channel is configured, it is selected as the active channel and the first beam transmit/receive sequence begins, having a dwell time 60. In accordance with this invention, at the conclusion of the first beam transmit/receive sequence, the second channel is selected as the active channel and the second beam transmit/receive sequence begins. The switching from the first channel to the second channel is accomplished using fast speed polarization rotators, and, as the second channel is already configured to generate the second beam, there is a relatively short dead time 65 between the successive transmit/receive sequences. The transmit/receive sequence for the second beam has a dwell time 70, during which channel one is reconfigured to generate the third beam. At the conclusion of second beam dwell time 70, there is a relatively short dead time 65' while channel one is selected as the active channel, after which the third beam transmit/receive sequence begins, which sequence has a dwell time 60'. During dwell time 60', channel two is reconfigured to form the fourth beam so that upon completion of the third beam transmit/receive sequence, after a short dead time 65'' to select channel two as the active channel, the transmit/receive sequence for beam 4 begins, which sequence has a dwell time 70'. During dwell time 70' channel one is reconfigured for forming beam 5, etc., so that in operation the phased array radar system has rapid beam scanning comprising successive transmit/-receive sequences generated by alternating channels. A typical dwell time is 5 msec, and typical dead times 65, 65', etc for selecting an active channel are in the range of 1–10 nanoseconds.

In the time-multiplexed beam scanning system of this invention, the next sequential beam scan position has to be known in order to configure the non-active channel for the next transmit/receive sequence. In accordance with the a priori or deterministic nature of radar beam scanning, the radar is programmed to follow a predetermined scan path. Thus, all the desired bean scan positions are known so that a control computer can be programmed with all desired channel optical control device switch configurations to implement time-multiplexing beam scanning operation. Further, in the tracking mode, the computer calculates the most likely target path based on earlier scans, using at least two know scan beams to determine the possible target trajectory/flight path. The processed return data thus provides a prediction of the target track, enabling the same time-multiplexed scanning technique to be used for search and track radar modes.

Figure 3:
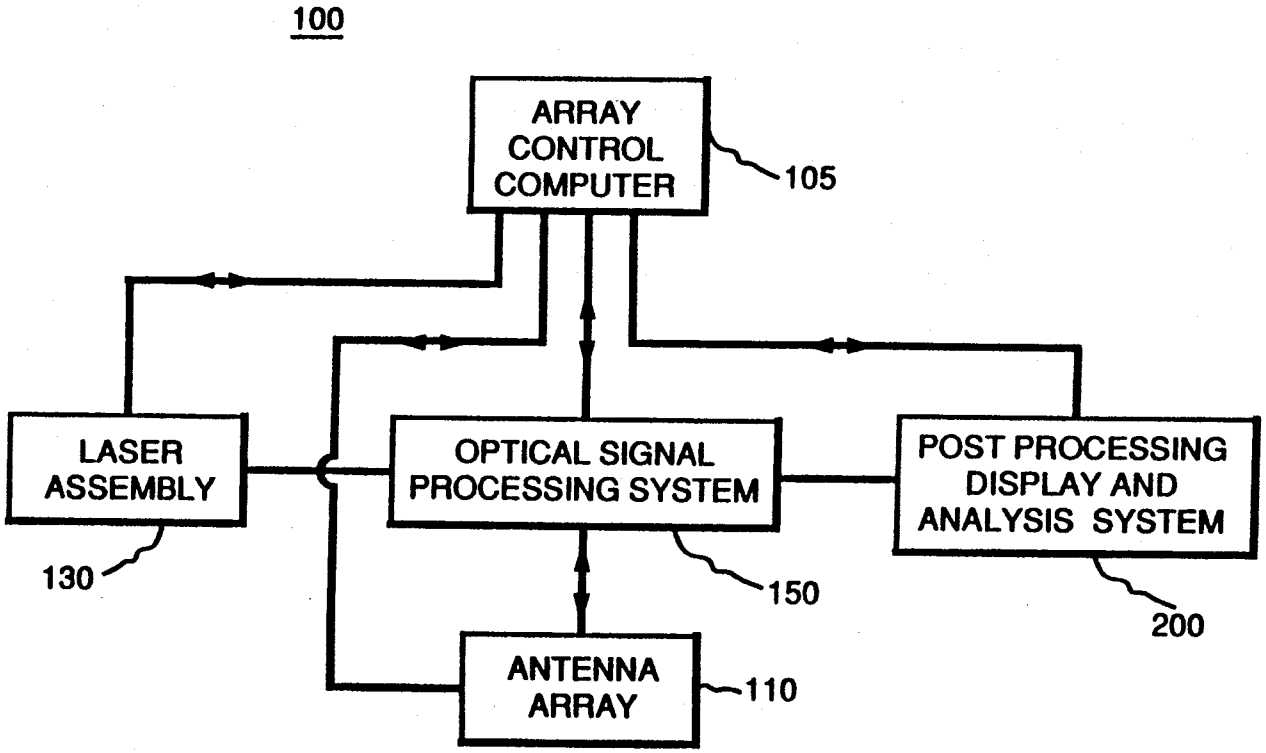
FIG. 3 is a block diagram of a phased-array antenna system comprising the present invention.

In FIG. 3, a phased array antenna system 100 used as a radar or the like comprises an array control computer 105, an antenna array assembly 110, a laser assembly 130, a two-channel optical signal processing system 150, and a post-processing display and analysis system 200. Array control computer 105 is coupled to the components listed above and generates signals to control and synchronize the operation, described below, of those components so that antenna system 110 can operate in both a transmit and a receive mode with selected beamforming characteristics for fast (hundreds of beams/sec) antenna beam scanning.

Figure 4:
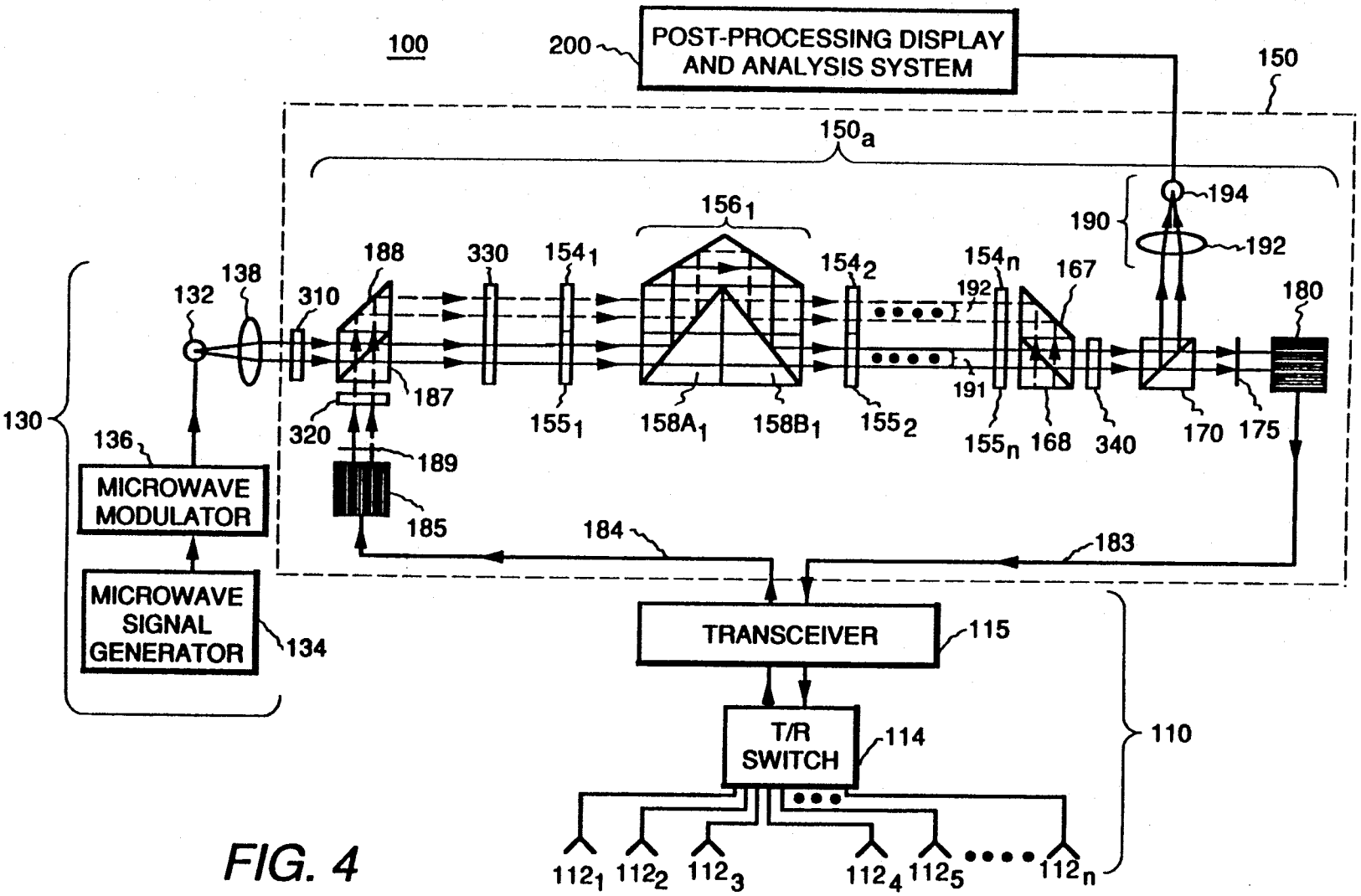
FIG. 4 is a partial schematic representation and partial block diagram of a time-multiplexed optically controlled phased-array antenna system of the present invention.

FIG. 4 illustrates in greater detail certain components of phased array antenna system 100. Electromagnetic energy is radiated by antenna array assembly 110 from a plurality of antenna elements or subarrays of antenna elements 112 when the system operates in the transmit mode. As used herein, an antenna element may comprise one or more radiating devices (not shown) which, when excited by an electrical signal (e.g., a microwave signal), radiates electromagnetic energy into free space. In a phased array system, the antenna elements may be arranged in any geometric pattern that provides the desired beamforming and detection capabilities for the array. Antenna elements or subarrays 112 are commonly arranged in rows and columns and the optimum number of elements varies based on the intended use of the array. For example, in a typical phased array radar system for target tracking, more than 1,000 antenna elements are used in the array. Some advanced arrays have between 4000 and 5000 antenna elements in an array.

Antenna elements 112 are coupled to signal processing system 150 via a microwave transmit/receive switch array 114, an optoelectronic transceiver array 115, a single mode transmit fiber array link 183, and a single mode receive fiber array link 184. Switch array 114 is controlled by array control computer 105 (FIG. 3), which generates a control command to change the condition of switch 114 between a transmit position and a receive position in coordination with other control signals for the optical signal processing system and the like. In the transmit mode, switch 114 couples antenna elements 112 to receive output control signals from signal processing system 150 conveyed by fiber array link 183 via the optoelectronic transceiver 115, which converts the optical output control signals from signal processing system 150 into corresponding electrical signals (e.g., microwave signals) using a photosensor array. The electrical signals generated in transceiver 115 pass through transmit/receive switch 114 set in its transmit position to drive antenna elements 112 to radiate electromagnetic energy along a selected beam path into free space.

In the receive mode, transmit/receive switch 114 couples the antenna elements to transceiver 115 so that electrical signals generated by antenna elements 112 in response to detected electromagnetic energy incident on the antenna elements, i.e. return or receive signals, are ultimately directed into signal processing system 150. For example, microwave signals detected by antenna elements 112 are coupled to optoelectronic transceiver 115 via transmit/receive switch 114. In transceiver 115 the electrical signals modulate an array of laser diodes to generate a corresponding optical return signal comprising a plurality of light beams. Fiber array link 184 is coupled to transceiver 115 and an input-port two-dimensional fiber array 185 so that the optical return signal is directed to optical signal processing system 150.

Figure 5:
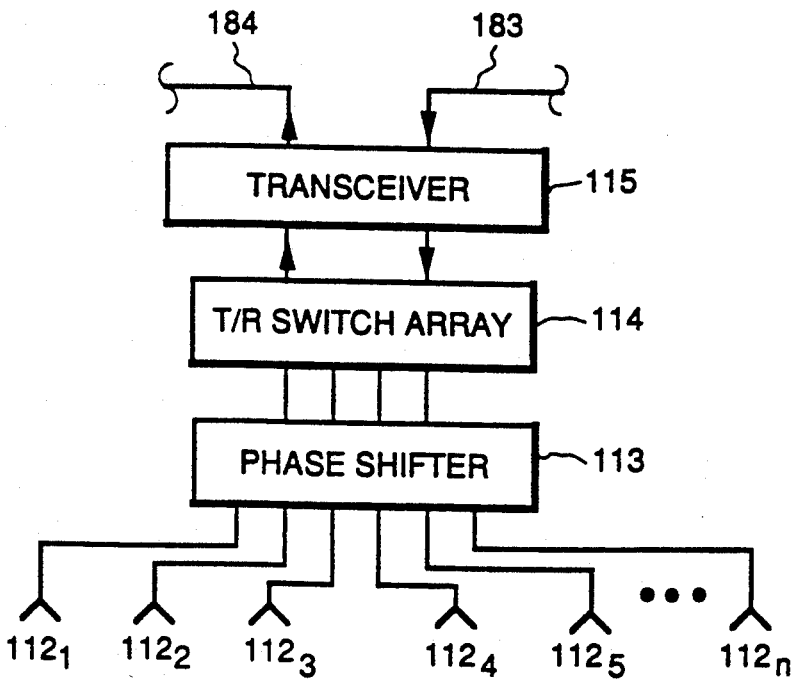
FIG. 5 is a partial schematic representation and partial block diagram of a portion of the time-multiplexed optically controlled phased-array antenna system in accordance with one embodiment of the present invention.

Particularly in antenna systems having large numbers of antenna elements, it is advantageous to group antenna elements in subarrays, with each subarray driven by one of the individual control signals generated by transceiver 115. As illustrated in FIG. 5, in such an alternative arrangement a phase shifter 113 is advantageously coupled to transmit/receive switch 114 so that electrical drive signals for each antenna subarray 112 passes through a 0–2$\pi$ phase shifter, thereby generating an individual drive signal for each antenna element in the subarray. The generation of individually phase-shifted drive signals for each antenna element results in a cumulative transmitted beam from the plurality of subarrays that is more equiphase than if every antenna element in each respective subarray were driven by the same respective subarray electrical control signal. Return beam signals from the antenna elements similarly pass through phase shifter 115 in which they are recombined into one subarray return signal and then pass through to transmit/receive switch 114.

Signal processing system 150 comprises optical architecture 150*a* to generate selected time delays in optical signals to drive antenna elements 112 in a transmit mode and to process the optical return signals derived from the detected return pulses. As used herein, "optical architecture" refers to the combination of optical control devices for manipulating the direction, polarization, and/or the phase or time delay of light beams.

Laser assembly 130 generates the light beams to provide an input signal to the optical architecture of signal processing system 150 to create the drive signals for antenna elements 112 in the transmit mode. A laser source 132 is advantageously a semiconductor laser, but may be any type of laser beam generator that can provide beams having selected characteristics of wavelength, intensity and modulation appropriate for operation of the optical signal processing system as described in this application. Laser source 132 is modulated by a microwave modulator 136 driven by a microwave signal generator 134 to produce laser pulses of the desired repetition frequency for use with the phased array antenna system. By way of example and not limitation, direct linear intensity modulation of the laser diode can be used which results in the intensity of the modulated light being linearly proportional to the amplitude of the microwave signal voltage and current driven by the laser. Modulator 136 may comprise a square root/bias circuit to produce the desired direct linear intensity modulation. Alternatively, modulation of the laser source through indirect laser beam intensity modulation may be performed by using an integrated-optic lithium niobate electro-optic modulator. In such an embodiment, fiber-optic input/output coupling is advantageously used with GRIN (graded index) rod or SELFOC (self-focussing) lenses used for output beam collimation.

Laser source 132 is optically coupled to a spherical lens 138 in which the modulated laser output light beam is divided into a plurality of individual light beams. As used herein, "optically coupled" to refers to an arrangement in which one or more light beams are directed from one optical component to another in a manner to maintain the integrity of the signal communicated by the light beams. Lens 138 also acts as an optical collimator to cause light beams passing from it to travel in parallel paths. Each individual light beam provides the control signal for driving a respective individual antenna element 112; thus the total number of beams into which lens 138 must separate the output beam of laser source 132 is determined by the number of antenna elements 112 which are to be driven by optical signal processing system 150. Similarly, the return or receive optical signal comprises a plurality of light beams corresponding to the number of antenna elements sampling the detected return beam.

Although a coherent or a relatively temporally incoherent output of laser assembly 130 may be used in accordance with this invention, the preferred embodiment of this invention utilizes relatively temporally incoherent light. As used herein, "relatively temporally incoherent light" refers to laser light with a relatively broad spectrum, or poor coherence length. Thus, for the purposes of first describing the invention, it will be assumed that the optical output light beam of laser assembly 130 is relatively temporally incoherent but polarized in a selected direction. For purposes of explanation, it will also be assumed that the output light beam of laser assembly 130 is polarized in the horizontal direction (p-polarized), although vertical (s-polarized) light can alternatively be used, so long as the particular polarization is selected for use in conjunction with the optical architecture as described below.

In accordance with the present invention, optical signal processing system 150 comprises a first signal processing channel 191 and a second signal processing channel 192. In FIG. 4, for ease of presentation two representative light beams defining each channel are illustrated, although each channel processes the plurality of light beams necessary to operate all of the antenna elements or subarrays. The time multiplexed fast antenna beam scanning operation described above with respect to FIG.2 is implemented by sequential or alternating operation of signal processing channels 191 and 192 so that one channel is active, i.e., controlling the transmit/receive sequence of phased array antenna system 100, while the non-active channel is reconfigured to control the next transmit/receive sequence.

In accordance with this invention, the time multiplexing mechanism to sequentially select the active channel comprises a plurality of single pixel fast speed 90° polarization rotators 310, 320, 330, and 340. Dependent on the control voltage (or setting) applied to each polarization rotator, polarized light either passes through unchanged or the polarization orientation of the light beam is rotated 90° (i.e., p-polarized light can be rotated to s-polarized light and vice versa). Each of these relatively fast speed polarization rotators advantageously comprises an electro-optic Pockels cell or Kerr cell having a switching time in the range of about 1–10 nanoseconds. Alternatively, each of the polarization rotators can comprise a single pixel ferroelectric liquid crystal polarization rotator, which typically has switching speeds in the range of 1–10 microseconds. Polarization rotators 310, 320, 330, and 340 are disposed in optical architecture 150*a* as described in detail below so that the polarization of the transmit light beams entering the optical architecture from laser assembly 130 or the receive light beams from transceiver 115 can be manipulated to select the channel through which the light beams pass and the configuration of the active channel for the transmit or receive mode portion of the sequence.

Laser assembly 130 is optically coupled to optical signal processing system 150 so that temporally incoherent, p-polarized, and collimated light beams pass through spherical lens 138 into transmit beam polarization rotator 310 and thence into a channel input polarizing beam splitter (PBS) 187. PBS 187 allows light of a selected polarization to pass directly through the device, but light of an opposite polarization is deflected at a right angle to the incident angle of the light. For example, as illustrated in FIG. 4, with transmit beam polarization rotator 310 selected (e.g., in the "off" state) to allow p-polarized light emanating from the laser assembly to pass unaltered, input PBS 187 allows the p-polarized light beams to pass directly through the PBS into first channel 191 in optical signal processing system 150. Conversely, with transmit beam polarization rotator 310 selected (e.g., in the "on" state) to rotate the p-polarized light from laser assembly 130 to s-polarized light, the s-polarized light passing from polarization rotator 310 into PBS 187 is deflected 90 degrees and into a 45 degree total internal reflecting corner prism 188 coupled to input PBS 187. Corner prism 188 in turn redirects the incident light beams into second channel 192 in the optical signal processing system 150. Thus by selectively switching transmit beam polarization rotator 310, light from the transmit mode light source 132 can be switched between the two processing channels in the optical signal processing system 150.

Light beams exiting channel input PBS 187 in each channel enter a respective cascade of optical devices coupled together and in which transmit and receive optical signals are processed as described below. Input PBS 187 is optically coupled to a cascade input fast switching polarization rotator 330. Light passing from input PBS 187 into first channel 191, for example, passes through cascade input polarization rotator 330 (the operation of which is discussed below with respect to the receive mode) into the first of a cascade, or series, of spatial light modulators (SLMs) $\mathbf{155}_1$–$\mathbf{155}_n$ and associated optical signal delay devices, for example free space delay devices $\mathbf{156}_1$–$\mathbf{156}_{n-1}$ (the last SLM ($\mathbf{155}_n$) in the cascade not having an associated free space delay unit. Similarly, light passing from input PBS and corner prism 188 into second channel 192 passes through cascade input polarization rotator 330 to the first of a series, or cascade, of spatial light modulators (SLMs) $\mathbf{154}_1$–$\mathbf{154}_n$ (separately controllable from the SLMs in first channel 191) and associated free space delay devices $\mathbf{156}_1$–$\mathbf{156}_{n-1}$ (which are advantageously the same free space delay units used in conjunction with first channel 191). Spatial light modulators $\mathbf{154}_1$–$\mathbf{154}_n$ and $\mathbf{155}_1$–$\mathbf{155}_n$ each comprise two-dimensional pixelated electrically addressed liquid crystal devices typically having pixels arranged in columns and rows forming an array of A×B pixels. The liquid crystal devices can advantageously be twisted nematic cells, parallel-rub birefringent mode cells, or liquid crystal gels. The pixels in this SLM array are individually illuminated by light beams arranged in a corresponding A×B matrix, which light beams emerge from lens 138 in the transmit mode and from optical receive signal fiber array 185 in the receive mode and pass through channel input PBS 187 into the selected active channel. Each pixel in each respective SLM acts as a polarization rotator, rotating the polarization of the incident light beam by 0 or 90 degrees (e.g., if the pixel is selected to cause rotation of the polarization orientation of incident light, p-polarized light would be rotated to s-polarized light and vice versa). The selected control voltages applied to the pixel determines the orientation of liquid crystals in the cell which in turn determines whether the polarization orientation of light passing through the cell will be rotated. The polarization of each of the incident light beams can be selectively adjusted by changing the control signals to the pixel array of an SLM. Such control signals are provided by array control computer 105 (FIG. 3).

Each cascade has a similar but independently controllable optical architecture. In the discussion below, the structure and operation of first channel 191 (FIG. 4) is used as an example. SLM $\mathbf{155}_1$ is optically coupled to an associated free space delay unit $\mathbf{156}_1$. As used herein, an "associated free space delay device" refers to sequentially adjacent SLMs and free space delay units in the cascade of these devices, e.g. SLM $\mathbf{155}_1$ and free space delay unit $\mathbf{156}_1$, SLM $\mathbf{155}_2$ and free space delay unit $\mathbf{156}_2$, etc. Each free space delay unit comprises a pair of polarizing beam splitters optically coupled to a prism, into which a light beam is deflected if it is to be time delayed in that free space delay unit. For example, light beams emerging from SLM $\mathbf{155}_1$ are incident on delay unit $\mathbf{156}_1$ and first enter a polarizing beam splitter (PBS) $\mathbf{158A}_1$. Dependent on the polarization of the incident light beams, the beam either passes directly through PBS $\mathbf{158A}_1$ into PBS $\mathbf{158B}_1$ and continues in the same direction to the next SLM in the cascade, or it is deflected by 90 degrees in PBS $\mathbf{158A}_1$. Light beams deflected 90 degrees enter a prism $\mathbf{159}_1$, in which the light beam traverses a path reflecting off walls of the prism before it is directed into PBS $\mathbf{158B}_1$, in which the light is again deflected by 90 degrees to rejoin the path on which it was travelling at the time it entered free space delay device $\mathbf{156}_1$. As a deflected beam will have travelled a greater distance in passing through the prism as compared to a companion beam that was not deflected by PBS $\mathbf{158}_1$, it will have a time delay with respect to the undeflected beam.

SLM $\mathbf{155}_2$ is optically coupled to further free space delay units so that light beams passing out of free space delay unit $\mathbf{156}_1$ will illuminate the A×B pixelated array of SLM $\mathbf{155}_2$. The polarization orientation of each light beam can again be selected by controlling the pixels in each SLM to either rotate or not rotate the light beam. SLM $\mathbf{155}_2$ is optically coupled to a further associated free space delay unit (not shown) which acts on the plurality of p- and s-polarized light beams in a manner similar to that described above with respect to free space delay unit $\mathbf{156}_1$. The further associated free space delay unit (not shown) typically provides a longer path for the light to traverse, thereby creating a longer delay time than prism $\mathbf{159}_1$ with respect to an undeflected beam. Similarly, each subsequent free space delay unit in the cascade would create a longer time delay in a deflected light beam.

Figure 6:
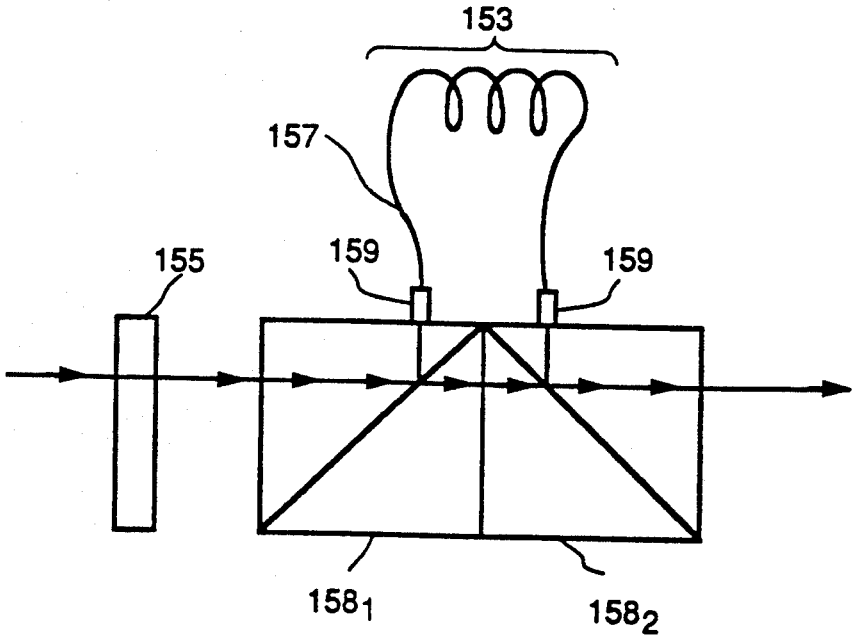
FIG. 6 is a schematic representation of an optical signal time delay unit in accordance with one embodiment of this invention.

Alternatively, an optical signal delay device such as optical fiber delay unit 153 can be used in lieu of prism-based free space delay units 156. As illustrated in FIG. 6, optical fiber delay unit 153 comprises a polarizing preserving fiber delay line 157 coupled at either end to polarizing beam splitters $\mathbf{158}_1$ and $\mathbf{158}_2$ respectively through GRIN rod lenses 159, which lenses collimate the light beams entering and exiting delay line 157. The length of delay line 157 is selected to provide the desired time delay to the optical signal. The operation of the fiber delay unit 153 is similar to the free space delay units described above, with the polarity of the light passing through the pixels of SLM 1551 being selected to be pass through PBS $158_1$ and $158_2$ undeflected or to be deflected into delay line 157 to be time-delayed. Optical fiber delay units 153 are advantageously used in optical architecture 150*a* when longer time delays than what can be reasonably produced by free space delay units are desired. For ease of discussion, only free space delay units are referred to in the further description of FIG. 4, although the description similarly applied to a device including optical fiber delay units.

The cascade of associated SLMs and free space delay units, in each respective channel, up to "n−1" (the last SLM in the cascade not having an associated free space delay unit) such associated groups, affords the opportunity to produce $2^{n-1}$ different delay values for light beams passing through the optical signal processing system. Time delays for individual beams are determined by the number of free space delay units in which the beam is deflected through the prism and the length of the path that the light beam travels through each of the prisms-based paths, or the number of fiber delay units through which the beam is directed.

The last free space delay unit (not shown in FIG. 4) in the cascade is optically coupled to output SLMs $155_n$ and $154_n$ for the first channel 191 and second channel 192, respectively. SLMs $155_n$ and $154_n$ are each respectively controlled to selectively rotate the polarization orientation of individual light beams passing through their A×B pixelated display so that each light beam in a given channel emerging from the respective output SLM has the same polarization. As the polarization orientation of each of the light beams at the output of free space delay unit $156_{n-1}$ (not shown) is determinable based upon the orientation shifts made as the beams passed through the cascade of SLMs and associated free space delay devices in a particular channel 191 or 192, the pixel control voltages are adjusted on the output SLMs $155_n$ and $154_n$ to rotate light beams to a selected polarization orientation, such as p-polarity. Light beams already having the selected polarization orientation pass through the output SLMs $155_n$ and $154_n$ unrotated; thus all light beams emerging from the SLM $155_n$ and $154_n$ have the selected polarization orientations desired for their respective channels 191 and 192.

SLM $155_n$ (first channel) is optically coupled to a channel output polarizing beam splitter 168; SLM $154_n$ (second channel) is optically coupled to a 45° totally internally reflecting corner prism 167 which is in turn optically coupled to channel output PBS 168 so that light passing from second channel 192 is deflected into PBS 168. PBS 168 in turn is optically coupled to a cascade output fast switching polarization rotator 340, which in turn is optically coupled to a signal output path PBS 170.

Light beams emerging from SLM $155_n$, i.e. first channel 191 optical signals in either the transmit or receive mode, must be p-polarized, such that the beams pass undeflected through channel output PBS 168 into cascade output polarization rotator 340. When the first channel is in the transmit mode, polarization rotator 340 is in the off mode (non polarization rotating) so that the p-polarized light passes undeflected through signal output path PBS 170 and into a focusing lenslet array 175 that directs the time-delayed optical signals into a two-dimensional single mode optical fiber array 180. Fiber array 180 comprises an array of A×B fibers (preferably with GRIN rod lenses for better coupling) corresponding to the plurality of light beams emerging from output path PBS 170. The light beams of the transmit optical control signals incident on array 180 are carried in the multi-fiber link 183 to a corresponding photosensor array in transceiver 115, where the optical signals are converted to corresponding electrical signals. The electrical signals generated by photosensor array are delayed by time intervals corresponding to the time delays imparted to the optical control signals; these electrical signals are coupled through transmit/receive switch 114 to antenna elements 112, which, when excited by the electrical signals, radiate electromagnetic radiation into free space in the desired direction.

The operation of the second channel is similar to that described for the first channel. In the second channel, however, light beams emerging from the second channel cascade are uniformly polarized to s-polarized light by SLM $154_n$. The s-polarized light enters corner prism 167 and is deflected by 90° into channel output PBS 168, and deflected again by 90° to follow the same path as the light beams from the first channel follow into polarization rotator 340. Polarization rotator 340 is controlled to rotate the second channel light beams to a p-polarization when the channel is in a transmit mode so that the light beams pass through signal output path PBS and on to transceiver 115. Conversely, in the receive mode, the s-polarized light is passed unaltered.

Optical signal processing system 150 processes both signals used in both transmit and receive modes for each channel. The optical architecture described above, from channel input PBS 187 to channel output PBS 170, operates in the receive mode in a similar fashion as the transmit mode. In the receive mode, however, the optical input signals are received via an input port two dimensional single mode fiber array 185 from the laser diode array in transceiver 115, and the optical signals passing from the respective channel cascades are directed to detector assembly 190. The laser diodes used in the optical transceiver modules 115 may be of any type that are capable of producing a laser light pulse of an intensity and frequency compatible with the optical architecture in response to the electrical signals received from transmit/receive switch 114. Receive multi-fiber link array 184 which couples the laser diodes to single mode fiber array 185 preferably comprises polarization preserving fibers. Two dimensional fiber array 185 is optically coupled to channel input PBS 187 via a collimating lenslet array 189 and a receive beam selection fast switching polarization rotator 320. Fibers with GRIN lenses can alternatively be used instead of lenslet array 189 to collimate the optical signals transported by fiber array 185, which comprises a plurality of fibers arranged in an A×B array corresponding to the array pattern used in the optical architecture for processing the transmit signals.

In operation, electrical return signals generated by antenna elements 112 in response to detected electromagnetic radiation are electrically conducted to the laser diodes which convert the electrical signals into corresponding optical return signals via the link 184. The condition (on or off) of polarization rotator 320 is controlled to cause the light beams entering channel input PBS 187 to be deflected into the respective channel that is selected to be active so that the return signals enter the same cascade of SLMs 154 (first channel) or SLMs 155 (second channel) and free space delay units 156 through which the transmit control signals were formed for that transmit/receive sequence. The paths followed by individual light beams passing through the cascade of SLMs and free space delay units is the same as described above with respect to the optical signals processed in the transmit mode.

Light beams emerging from a cascade are deflected by channel output PBS 170 into photosensor detector assembly 190, which comprises a combining lens 192 and an optical detector 194. Combining lens 192 focuses the plurality of receive mode light beams onto detector 194 which converts the combined optical return signals into an electrical return signal, the strength of which depends on the instantaneous intensity of the combined light beams on detector 194. Detector 194 is electrically coupled to post-processing display and analysis system 200 for producing a display or for further processing of the signal information.

When optical signal processing system 150 is operating in the receive mode, as directed by array control computer 105, the cascade output path polarization rotator 340 is in the on-state when using first channel 191, such that s-polarized light is incident on signal output path PBS 170 so that the light beams are deflected into detector assembly 190. For example, when first channel 191 is selected as the active channel and in the receive mode, s-polarized light beams generated in transceiver array 115 pass through fiber array 185, and through off-state (non polarization rotating) receive beam polarization rotator 320 into channel input PBS 187. The s-polarized light is deflected by 90° in channel input PBS 187 to enter the first channel cascade. The light beams exiting PBS 187 then pass through cascade input path polarization rotator 330, which rotates the receive or return optical signals to the desired p-polarized orientation for processing in the first channel optical architecture using the same SLM control settings as were used for processing the transmit signal. The processed light beams emerging from the first channel cascade are uniformly polarized to p-polarized light in SLM $155_n$ and pass through channel output PBS 168 to cascade output path polarization rotator 340. When the first channel is in the receive mode, polarization rotator 340 is in the on mode (rotating the polarization) so that the p-polarized light emerges as s-polarized light that in turn enters signal output path PBS 170 and is deflected by 90° to enter photosensor detector assembly 190.

When the channel 192 is selected as the active channel, s-polarized light from input fiber array 185 passes into receive beam polarization rotator 320 and is rotated to p-polarized light. The p-polarized light passes through channel input PBS and into corner prism 188 in which it is deflected into the second channel 192 cascade. The light then passes into on mode cascade input polarization rotator 330 so that the polarization of the light beams is rotated back to s-polarized light, which then continues through the cascade to be processed by the SLMs having the same control settings as when the transmit beam was processed. The s-polarized light beams pass from the cascade, are deflected into and through corner prism 167 and channel output PBS 168 and through off mode cascade output polarization rotator 340 into signal output path PBS 170, in which they are deflected into photosensor detector assembly 190.

In the receive mode, phased array antenna system 100 is used to "view" a particular angle of space with respect to the antenna array to determine the intensity of electromagnetic radiation of the desired frequency being received from that direction. In a radar system, for example, the strength or intensity of the radiation received from a given angle determines whether a target is detected in that direction. The time delays set in the cascade of free space delay units and associated SLMs determine the beam angle of the phased array antenna in either a transmit or a receive mode. Thus, in the receive mode, only the sum of the signals detected by the antenna array from a selected direction is necessary to determine the presence of reflected electromagnetic radiation from that beam angle.

The time multiplexed fast beam scanning operation of the signal processing system can be summarized by the following chart reflecting for each channel in transmit and receive modes the state of the fast speed polarization rotators (identified by the reference numerals in FIG. 4) and the transmit laser source 130:

| Channel | Mode* | laser 130 | 310 | 320 | 330 | 340 |
|---|---|---|---|---|---|---|
| 1 | Trans | on | Off | n/a | off | off |
| 1 | Rec | off | n/a | off | on | on |
| 2 | Trans | on | on | n/a | off | on |
| 2 | Rec | off | n/a | on | on | off |

[n/a refers to a condition in which the light source in the selected optical path is turned off]
*the mode corresponds to the position of transmit/receive switch array 114

It will be readily understood by those skilled in the art that the present invention is not limited to the specific embodiments described and illustrated herein. Many variations, modifications and equivalent arrangements will now be apparent to those skilled in the art, or will be reasonably suggested by the foregoing specification and drawings, without departing from the substance or scope of the invention. Accordingly, it is intended that the invention be limited only by the spirit and scope of the appended claims.

What is claimed is:

1. A time multiplexed opto-electronic signal control system for processing an optical input signal having a predetermined polarization, comprising:

an opto-electronic signal processing system comprising at least a first and a second signal processing channel, said first and second channel each being adapted to selectively receive said optical input signal and generate a respective channel optical output signal, each of said channels further comprising a plurality of relatively slow speed optical processing devices sequentially coupled together, each of said optical processing devices being adapted to be individually selectively controlled to cumulatively generate respective time-delayed channel optical output signals from each channel; and time multiplexing means for rapidly switching between respective ones of said signal processing channels to select an active channel to produce a control system output signal comprising sequential ones of active channel output signals and having a relatively short dead time between said sequential active channel output signals;

each of said plurality of relatively slow speed optical processing devices in the non-active channel being adapted to be controlled independently of and concurrently with the operation of said optical processing devices in said active channel to establish an optical configuration to process the next sequential system output signal.

2. The system of claim 1 wherein each said relatively slow speed optical processing devices comprises a liquid crystal spatial light modulator.

3. The system of claim 2 wherein each channel of said opto-electronic processing system comprises a cascade of optical processing devices, each of said cascades comprising a plurality of said spatial light modulators optically coupled to an associated optical signal time delay device.

4. The system of claim 3 wherein said optical signal time delay device comprises a device selected from the group comprising a free space delay unit and an optical fiber delay unit.

5. The system of claim 4 wherein said time multiplexing means comprises a plurality of fast switching 90° polarization rotators.

6. The system of claim 5 wherein said fast switching 90° polarization rotators each comprise an electro-optic device selected from the group comprising Pockels cells, Kerr cells, and ferroelectric liquid crystal polarization rotators.

7. The system of claim 5 wherein said opto-electronic signal processing system further comprises:

a channel input polarizing beam splitter, a channel output polarizing beam splitter, and a signal output path polarizing beam splitter, said channel input polarizing beam splitter being disposed to receive the selected optical input signal from either of two separate input light paths and to cause said optical input signal to be directed into a predetermined one of said channels, said channel output polarizing beam splitter being coupled to receive said selected time-delayed channel optical output signals from each of said channels, and said output path polarizing beam splitter being disposed to receive said channel output single from said channel output polarizing beam splitter.

8. The system of claim 7 wherein said plurality of channel selection fast switching 90° polarization rotators comprises:

a transmit beam polarization rotator and a return beam polarization rotator each optically coupled to said channel input beam polarizing beam splitter along respective ones of said input light paths, each of said polarization rotators being individually controllable to rotate the polarization of light beams passing therethrough so as to direct said light beams to a selected one of said signal processing channels;

a cascade input path fast switching 90° polarization rotator coupled to said channel input polarizing beam splitter so that light beams emerging from said channel input polarizing beam splitter pass therethrough; and a cascade output path fast switching 90° polarization rotator coupled to said channel output polarizing beam splitter so that light beams pass therethrough prior to entering said signal output path polarizing beam splitter;

said cascade input and cascade output path polarization rotators being selectively controllable to rotate the polarization of said light beams passing therethrough so as to determine the signal output path to which said light beams are deflected in said signal output path polarizing beam splitter.

9. The system of claim 8 wherein said channel input and channel output polarizing beam splitters each further comprise an associated totally internally reflecting corner prism coupled thereto, said corner prisms being disposed so as to deflect light beams of a selected polarization into a predetermined one of said channels.

10. A phased array antenna system comprising:

a plurality of antenna elements arranged in an array, said array being operable in a transmit or a receive mode;

an optical signal processing system coupled to said array and having a plurality of input and output signal paths corresponding to respective transmit and receive sequences of said array, said system being adapted to generate differentially time-delayed optical control signals to control output beam radiation patterns transmitted from said array and to optically process return radiation patterns detected by said array in each of said transmit and receive sequences, said system comprising at least a first and a second signal processing channel each comprising a plurality of relatively slow speed optical processing devices, each of said optical processing devices being adapted to be individually selectively controlled to cumulatively generate a respective channel optical output signal;

a modulated laser source optically coupled to said signal processing system to provide an optical input transmit signal having selected characteristics of wavelength, intensity, and modulation, said laser source including means for dividing said optical input transmit signal into a plurality of transmit light beams;

an optoelectronic transceiver array to convert the transmit optical control signals into electric array control signals and to convert electrical signals generated by the antenna array in response to return radiation patterns into optical input receive signals comprising a plurality of receive light beams; and time multiplexing means for rapidly switching between said signal processing channels to provide rapid shifting between a transmit and receive sequence of one of said channels and a transmit and receive sequence of the other of said channels with a relatively short dead time therebetween, said slow speed optical processing devices each being adapted to be individually selectively controlled to configure a respective channel to generate a predetermined transmit and receive sequence control signal during the transmit and receive sequence of the other respective channel.

11. The system of claim 10 wherein each of said optical signal processing channels further comprises:

a cascade of optical processing devices, each of said cascades comprising a plurality of spatial light modulators each coupled to an associated optical signal time delay device.

12. The system of claim 11 wherein said optical signal time delay device comprises a device selected from the group comprising a free space delay unit and an optical fiber delay unit.

13. The system of claim 12 wherein each of said spatial light modulators comprises a nematic liquid crystal.

14. The system of claim 12 wherein said optical signal processing system further comprises:

a channel input polarizing beam splitter having an associated totally internally reflecting corner prism and being coupled to each of said respective cascades and disposed to receive said input transmit and receive light beams so that said light beams pass to predetermined ones of said channels dependent on the polarization of said light beams;

a channel output polarizing beam splitter having an associated totally internally reflecting corner prism and optically coupled to receive said light beams passing from said respective cascades; and a signal output path polarizing beam splitter being disposed to receive said light beams passing from said optical processing channels and to direct said light beams along respective ones of said output paths dependent on the polarization of said light beams.

15. The system of claim 14 wherein said time multiplexing means comprises a plurality of fast switching polarization rotators disposed to selectively control the polarization of said light beams passing through said optical processing system.

16. The system of claim 15 wherein said fast switching polarization rotators each comprises an electro-optic device selected from the group comprising Pockels cells, Kerr cells, and ferroelectric liquid crystal polarization rotators.

17. The system of claim 15 wherein each of said polarization rotators is of a type that exhibits a switching time less than 10 nanoseconds.

18. The system of claim 15 further comprising:

a transmit beam fast switching polarization rotator coupled to said channel input polarizing beam splitter and disposed so that said transmit light beams pass therethrough prior to said transmit light beams entering said channel input polarizing beam splitter;

a return beam fast switching polarization rotator coupled to said channel input polarizing beam splitter and disposed so that said receive light beams pass therethrough prior to said receive light beams entering said channel input polarizing beam splitter;

a cascade input fast switching polarization rotator coupled to said channel input polarizing beam splitter and disposed so that light beams passing from said input polarizing beam splitter in respective ones of said channels pass therethrough; and a cascade output path fast switching polarization rotator coupled to said channel output polarizing beam splitter;

said cascade input and output path fast switching polarization rotators being controllable to determine the polarization of said light beams passing therethrough so that said beams are selectively directed in said signal output path polarizing beam splitter to a predetermined output path.

19. The system of claim 18 wherein said optoelectronic transceiver array comprises a photosensor detector assembly and an array of laser diodes.

20. The system of claim 19 wherein said modulated laser source comprises a semiconductor laser and means electrically coupled to said laser for direct linear modulation of said laser.

21. The system of claim 20 further comprising a phase shifter coupled to said optoelectronic transceiver array and said antenna array so that said electric array control signals and said electrical signals generated by the antenna array in response to return radiation patterns pass therethrough.

22. In a radar system, the system of claim 18 further comprising an array control computer coupled to said optical control system, said laser source, and said antenna array to control operation of said phased array antenna system in said transmit and said receive modes.

23. The radar system of claim 22 further comprising a post-processing display and analysis system.

24. A method of processing optical signals to control a phased array antenna having a plurality of antenna elements, comprising the steps of:

causing said phased array antenna to emit and receive electromagnetic radiation along a selected beam path in a predetermined transmit and receive sequence having a selected dwell time; and time multiplexing the operation of an antenna array control system having at least two signal processing channels to switch rapidly between said channels to select respective transmit and receive sequences to drive said phased array antenna to produce relatively short dead times between the dwell times of the respective transmit and receive sequences;

wherein the step of time multiplexing the operation further comprises configuring a plurality of channel optical signal processing devices in the non-driving signal processing channel during the dwell time of the driving channel.

25. The method of claim 24 wherein:

the step of causing said antenna to emit further comprises the step of optically processing a plurality of selectively time-delayed transmit signals to control the generation of electromagnetic signals emitted from respective ones of said antenna elements; and the step of causing said antenna to receive further comprises the step of optically processing detected return signals to produce a receive signal for input to a post processing display and analysis system.

26. The method of claim 25 wherein said transmit and detected return signals are in the form of light beams and the steps of optically processing said transmit and detected return signals in each of said signal processing channels further comprise:

respectively directing the light beams comprising said transmit and detected return signal through a cascade of spatial light modulators and associated free space delay units so as to selectively differentially delay each of said light beams, each of said spatial light modulators being individually controllable to produce the selected differential delay of each light beam passing through said cascade.

27. The method of claim 26 wherein the step of time multiplexing the operation of said antenna control system further comprises the steps of:

alternately switching the optical input signal for a selected one of said optical processing channels between a laser source and a return beam photoconverter and correspondingly switching the optical output signal of said selected one processing channel between a transmit beam photoconverter and a display and analysis system photoconverter so as to generate a first channel transmit and receive sequence;

alternately switching the optical input signal for a selected second of said optical processing channels between a laser source and a return beam photoconverter and correspondingly switching the optical output signal of said selected second processing channel between a transmit beam photoconverter and a display and analysis system photoconverter so as to generate a second channel transmit and receive sequence; and rapidly switching between said first and said second signal processing channels in an alternating succession to select an active channel driving said antenna array control system during a dwell time for a predetermined transmit and receive sequence; and adjusting the control voltages of the non-driving signal processing channel spatial light modulators during the dwell time of the active channel.

28. The method of claim 27 wherein the step of rapidly switching between said first and second signal processing channels comprises the steps of selectively controlling a plurality of fast switching polarization rotators disposed in the path of said transmit and detected return signals.

* * * * *